US007469552B2

(12) United States Patent
Brunner et al.

(10) Patent No.: US 7,469,552 B2
(45) Date of Patent: Dec. 30, 2008

(54) ICE DELIVERY AND CLEANING APPARATUS

(75) Inventors: Roger P. Brunner, Wind Gap, PA (US); James Vorosmarti, Center Valley, PA (US)

(73) Assignee: Follett Corporation, Easton, PA (US)

( * ) Notice: Subject to any disclaimer, the term of this patent is extended or adjusted under 35 U.S.C. 154(b) by 0 days.

(21) Appl. No.: 11/782,699

(22) Filed: Jul. 25, 2007

(65) Prior Publication Data

US 2008/0011000 A1 Jan. 17, 2008

Related U.S. Application Data

(62) Division of application No. 11/172,347, filed on Jun. 30, 2005, now Pat. No. 7,263,844.

(51) Int. Cl.
*F25C 1/14* (2006.01)

(52) U.S. Cl. ..... 62/320; 62/354

(58) Field of Classification Search ..... 62/320, 62/354

See application file for complete search history.

(56) References Cited

U.S. PATENT DOCUMENTS

| | | | | | |
|---|---|---|---|---|---|
| 2,962,878 | A | * | 12/1960 | Keller | 62/320 |
| 3,049,895 | A | * | 8/1962 | Larson et al. | 62/320 |
| 3,139,740 | A | * | 7/1964 | Swatsick | 62/320 |
| 3,196,628 | A | * | 7/1965 | Reynolds | 62/137 |
| 3,769,809 | A | * | 11/1973 | Robinson et al. | 62/137 |
| 3,863,463 | A | * | 2/1975 | Utter et al. | 62/354 |
| 4,198,831 | A | * | 4/1980 | Barnard et al. | 62/320 |
| 4,248,276 | A | | 2/1981 | Gosnell | |
| 4,276,750 | A | * | 7/1981 | Kawasumi | 62/137 |
| 4,429,543 | A | * | 2/1984 | Fischer | 62/73 |
| 4,497,184 | A | * | 2/1985 | Utter et al. | 62/354 |
| 4,574,593 | A | * | 3/1986 | Nelson | 62/320 |
| D333,405 | S | | 2/1993 | Moyer, Jr. et al. | |
| 5,211,030 | A | | 5/1993 | Jameson | |
| 5,336,334 | A | | 8/1994 | Johnson | |
| 5,542,573 | A | | 8/1996 | Frantz | |
| 5,797,514 | A | | 8/1998 | Twiggar et al. | |
| 5,887,758 | A | | 3/1999 | Hawkes et al. | |
| 5,993,117 | A | | 11/1999 | Lancaster et al. | |
| 6,134,908 | A | | 10/2000 | Brunner et al. | |
| 6,167,711 | B1 | | 1/2001 | Slattery et al. | |
| 6,540,067 | B1 | | 4/2003 | Sellers et al. | |
| 6,571,573 | B1 | | 6/2003 | Henry | |
| 6,596,233 | B2 | | 7/2003 | Berge et al. | |
| 6,685,053 | B2 | | 2/2004 | Hawkes et al. | |
| 6,767,408 | B2 | | 7/2004 | Kenowski et al. | |
| 6,857,284 | B1 | | 2/2005 | Brooks | |

* cited by examiner

*Primary Examiner*—William E Tapolcai
(74) *Attorney, Agent, or Firm*—Paul & Paul

(57) ABSTRACT

Apparatus transports rod(s) of ice of flaked or chipped ice through a tube to a remote ice bin, in which the ice is broken into nuggets. A method of cleaning the transport tube is also provided in which ice pushes a dry conformable article and a wet conformable articles carrying sanitizing solution through the tube, with the conformable articles preferable being sponges, and with the wet article sanitizing algae, bacteria, etc. during movement through the tube, and with the dry conformable article scraping debris from wall(s) of the tube during transport.

5 Claims, 5 Drawing Sheets

ICE RETAINING MEANS

ICE RETAINING MEANS

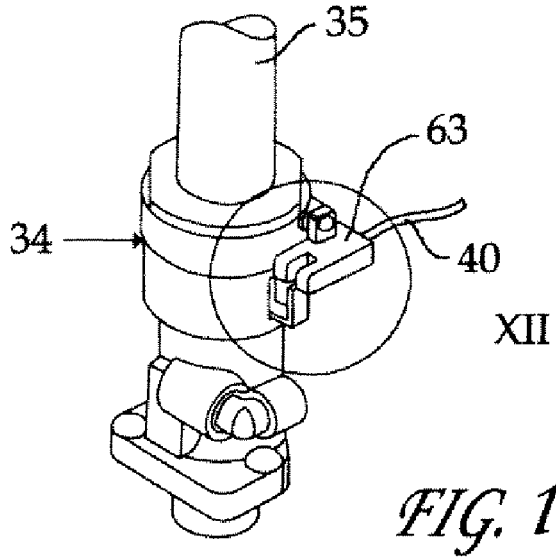
FIG. 11
FIG. 12
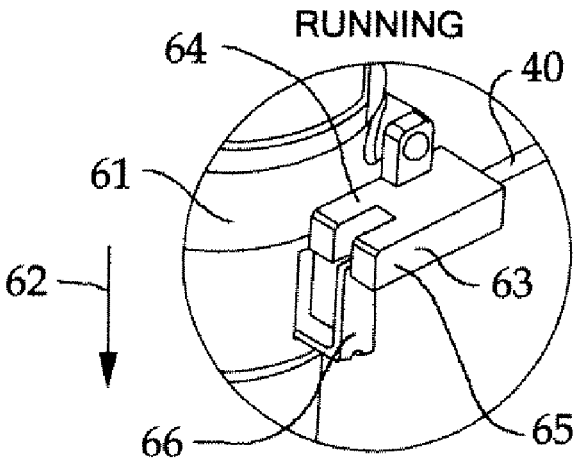
FIG. 13
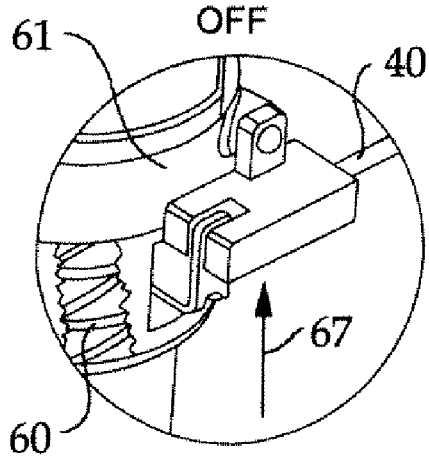

ICE DELIVERY AND CLEANING APPARATUS

CROSS-REFERENCE TO RELATED APPLICATION

This application is a divisional of U.S. Ser. No. 11/172,347 filed Jun. 30, 2005 now U.S. Pat. No. 7,263,844.

BACKGROUND OF THE INVENTION

This invention relates to ice delivery and cleaning apparatus, preferable for use in a commercial setting, and especially for ice making apparatus of the auger-type which produces flaked or chipped ice by freezing water on an inner wall of a hollow freezing chamber, and in which an ice auger scrapes ice off a surface of the freezing chamber. The ice is then compressed and delivered to an ice bin or other storage or ice retaining means, generally in the form of one or more longitudinal rods of ice. The ice rod is broken up into nuggets of a predetermined size for delivery through the inlet of the ice bin or other retaining means.

As ice travels through the ice transport tube or other delivery means, it will generally be in the form of at least one longitudinal rod of ice, and will preferable be cylindrical in configuration, such that when the ice is broken up into nuggets, each of the nuggets will be cylindrical in configuration and of approximately equal longitudinal length. While the cross-sectional shape of each of the nuggets may preferable be cylindrical, due to the cross-section of the ice transport tube generally being cylindrical, it will be noted that it is possible to design other cross-sectional shapes for the ice nuggets depending upon the cross-sectional configuration of the ice transport tube.

When nuggets of ice are delivered into an ice bin, it can sometimes occur that the bin becomes filled with nuggets and the continued delivery of ice to the bin can create stresses to various bin components that can result in breakage or forced opening of bin lids or other components. Also, when ice is being delivered from the site of its formation to an ice bin or other ice retaining means that is remote from the location of ice formation, the ice transport tubes can take on increased lengths, possible lending themselves to build-up of mold, algae, or other organisms. Where ice is discharged into a bin that is located in close proximity to the ice-making, such delivery often involves the use of a chute that can readily be disassembled for cleaning and sanitizing. However, with increased distance between the ice-making apparatus and the ice storage bin or other ice retaining means, it is desirable to transport the ice via a tube.

It is known to provide cleaning systems for ice delivery tubes or other conveying systems. Some such cleaning system use pressurized air or vacuum to move ice in batches from the ice making equipment to the point of use. Some such systems sanitize the tube periodically by soaking a fabric plug in a solution and placing it into the tube through a valve, then propelling the fabric plug via pressure or vacuum provided to the tube throughout the length of the tube. Such systems generally operate at a high speed of delivery through the tube, such that contact time of the solution on the tube wall is extremely short resulting in the possibility that some organisms survive the cleaning process.

Other ice conveying systems clean and sanitize ice transport tubes by threading a wire or flexible wand through the tube from the ice machine to the point of use. Such systems may be satisfactory for very short (less than 10 feet) lengths of delivery tube. However, with increasing tube length, often having numbers of bends therein, it becomes impossible to thread anything through the tube because the friction of the inside of the tube becomes greater than the buckling strength of the flexible wand.

Still other ice conveying systems seek to sanitize the tube by making ice out of a sanitizing solution and transporting it through the tube, seeking to sanitize the tube as the frozen sanitizing solution moves through the tube. However, since such solutions are frozen, they do not perform as effectively as would be desired if they were a liquid at room temperature. Furthermore, all of the ice that is made from sanitizing solutions must be collected and discarded, and the ice machine must thereafter be run for a period of time with fresh water to push out any remaining solution from the tube, with such ices that is used to push out remaining solution from the tube being thereafter collected and discarded. Such is generally a long process and involves the use of personnel to oversee and collect the ice.

SUMMARY OF THE INVENTION

The present invention is directed to providing longitudinal rods of compressed flaked or chipped ice, delivering the same through a delivery tube, breaking up the rods of ice at an inlet to a storage bin or other ice retaining means by driving the longitudinal rod(s) of ice around an arcuate passageway at the inlet to the ice storage bin or other retaining means, with the arcuate passageway including a radial arc of a size selected to correspond to the desired length of nuggets.

The present invention also involves driving the longitudinal strip of compressed flaked or stripped ice from a rotatable auger apparatus that forms the ice, and delivering the ice through an ice delivery tube to a storage bin or other ice retaining means in the form of nuggets, and interrupting the delivery of ice to the ice storage bin or other retaining means depending upon the buildup of ice in the ice storage bin or other retaining means.

Preferably, the interruption of the delivery of ice nuggets to the storage bin or other retaining means occurs automatically upon ice nuggets reaching a certain level of ice buildup in the ice retaining means, and then automatically resumes delivery of additional nuggets, as permitted upon a reduction in ice buildup in the retaining means.

A method of cleaning an ice transport tube is also provided, in which a substantially wet conformable article is treated with a sanitizing solution, placed into the tube, preferable followed by the placement of a substantially dry conformable article into the tube (although the placement of such articles could be reversed), further followed by delivery of ice into the tube to follow and push the substantially dry and substantially wet conformable articles through the tube to a discharge point, at which they are collected. Preferably, the conformable articles are sponges, with a substantially dry sponge generally acting as a reasonable effective seal, preventing a majority of the sanitizing solution that is carried by the substantially wet sponge from mixing with ice in the tube, and with the substantially dry sponge scraping debris from the tube wall(s).

Accordingly, it is an object of this invention to provide, for an ice transport tube, a means of breaking up at least one longitudinal rod of ice into nuggets, at the inlet to an ice storage bin or other ice retaining means.

It is a further object of this invention to provide a method of cleaning an ice transport tube, by using wet and dry conformable articles, with the wet article providing a sanitizing solution, followed by a dry conformable article that separates the sanitizing solution provided with the wet conformable article from ice that drives both conformable articles through an ice transport tube.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

FIG. 1 is a schematic diagram of an ice making apparatus in accordance with the present invention and an ice transport tube or other delivery means for delivering ice over long distances to an ice storage bin or other ice retaining means, with a control means being schematically shown, for alternately interrupting and permitting further delivery of ice to the ice retaining means depending upon the level of buildup of ice in the ice retaining means.

FIG. 11 is an illustration of the shuttle actuator for alternately interrupting and permitting the flow of ice, for shutting off or permitting the driving operation of the auger, shown in fragmentary perspective view.

FIG. 12 is an enlarged detail view of a portion of the apparatus illustrated in FIG. 11, shown as detail XII of FIG. 11, with the illustration of FIG. 12 being in the ice delivery or "running" mode.

FIG. 13 is an illustration similar to that of FIG. 12, with ice deliver being in an "off" mode, and with the apparatus of FIG. 12 being partially broken away to illustrate an internal spring, which normally biases the apparatus in a "running" mode, but wherein ice build-up in the ice retaining means has caused the ice delivery to be in an "off" mode.

DETAILED DESCRIPTIONS OF THE PREFERRED EMBODIMENTS

Figure 1:
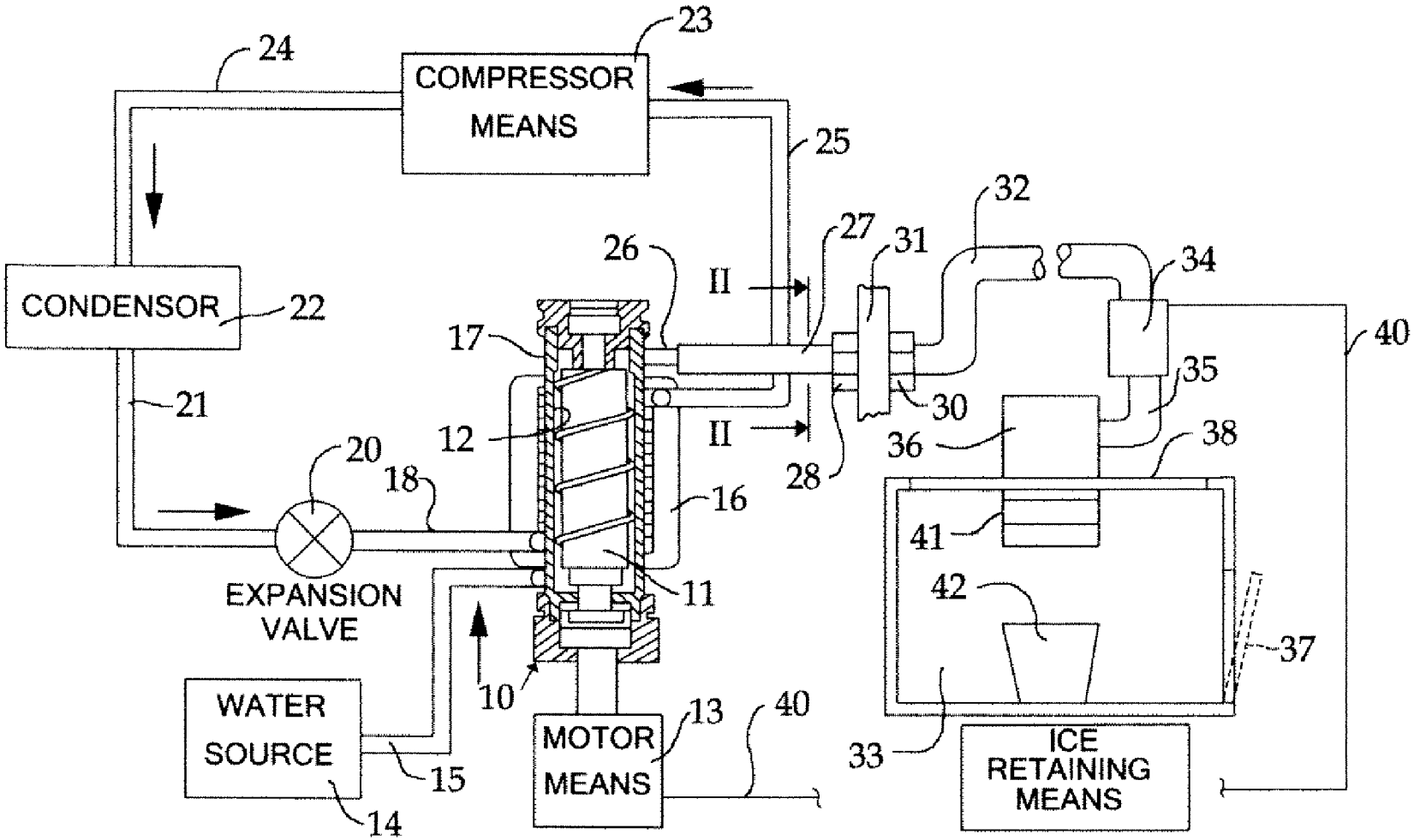

Referring now to the drawings in detail, there is shown an ice making apparatus in accordance with this invention, in a preferred embodiment. The illustrative apparatus is shown generally as comprising an auger-type ice generating apparatus of the rotatable auger type, having an auger 11 therein for scraping ice formed on an interior wall 12 thereof, as the auger 11 is driven by a motor means 13. Water is delivered from a water source 14 to the apparatus 10, via a water delivery line 15.

A refrigeration apparatus is comprised of a jacket 16 surrounding the cylindrical sleeve-like member 17 to which water is delivered via line 15, with the jacket 16 being supplied by refrigerant delivered via line 18 after passing through an expansion valve 20, being delivered thereto via line 21 from a condenser 22 that, in turn, is supplied from a compressor 23 to refrigerant line 24, with the compressor 23 receiving the refrigerant upon its return from the jacket 16, via line 25. The compressor means, condenser means, evaporator and expansion valve that comprise the refrigeration means can be as disclose in any of U.S. Pat. Nos. 3,126,719; 3,371,505; or 6,134,908, the disclosures of all of which are herein incorporated by reference.

Thus, ice that is scraped off wall(s) 12 is delivered from the chamber provided by the sleeve 17, to ice delivery lines 26, 27, in at least one longitudinal rod of compressed flaked or chipped ice, through connection nuts 28, 30 on opposite sides of fragmentarily illustrated wall 31, to an ice transport tube 32. The transport tube 32 is shown broken to illustrate its adaptability for the ice retaining means or ice bin 33, to which it supplies ice to be remotely located at a considerable distance within a facility, from the placement of the ice making apparatus 10, of compressor means 23, condenser 22, expansion valve 20 and water source 14. Thus, it will be understood that while the transport tube or ice delivery means 32 is shown proximate to the ice making apparatus 10 in FIG. 1, its placement will in most cases be remote from the ice making apparatus 10.

The transport tube 32 thus delivers ice through a delivery interrupting means 34, to a transport tube 35, and then to an ice breakup means 36 located proximate to the ice retaining means or ice storage bin 33.

The storage bin 33 may have a front opening 37, shown in phantom as pivoting outwardly for accessing ice from the bin 33, if desired, and/or may have an openable lid 38, as shown.

A control line 40, actuated by a sensor (later to be described) attached to the interrupting means 34, controls the operation of the motor means 13 for driving the auger 11, which in turn, drives ice via the tubes 26, 27, 32, 35 when permitted by the device 34. The interrupting means 36, when it allows for ice flow into the interior of the bin 33, does so through the inlet 41 to the bin 33, as shown.

Thus, ice that is delivered via tubes 27, 32, 35 may be in one or more longitudinal rods of compressed flaked or chipped ice, depending upon the number of bends through which the ice rods may pass from the auger apparatus 10 to the bin 33, in that the bends may provide some breaks in the rod or rods of ice.

It will also be understood that, in its preferred embodiment the cross-section of the tubes 26, 27, 32 and 35 will be cylindrical in nature, and consequently ice delivered therethrough will be in the form of cylindrical configuration(s), in the alternative, the cross-section of the transport tubes could be rectangular, triangular or of any other desired cross-section, as may be desired.

A bucket or other container 42 may, from time to time be placed inside the bin 33 during cleaning and sanitizing of the transport tubes, for collection of conformable articles that are used to clean and sanitize the tubes and collection of ice that pushes the conformable articles through the tubes, as will be described hereinafter.

Figure 2:
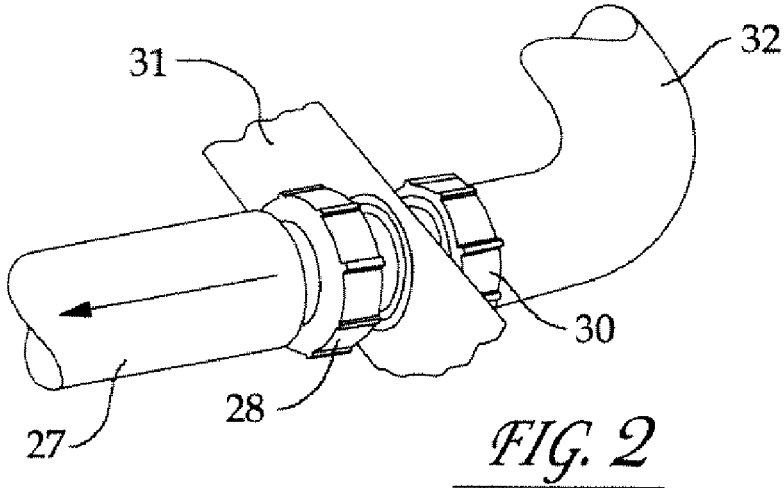
FIG. 2 is an enlarged fragmentary view of a portion of the ice transport tube shown in FIG. 1, taken generally along the line II-II of FIG. 1.

With reference now to FIG. 2, the transport tube portions 27 and 32 are shown as being in screw-threaded connection together, through a support wall 31, in that connectors 28 and 30 may be screwed tightly when the transport tubes are to be connected together, and may be unscrewed when it is desired to make an opening in the transport tube 27.

Figure 3:
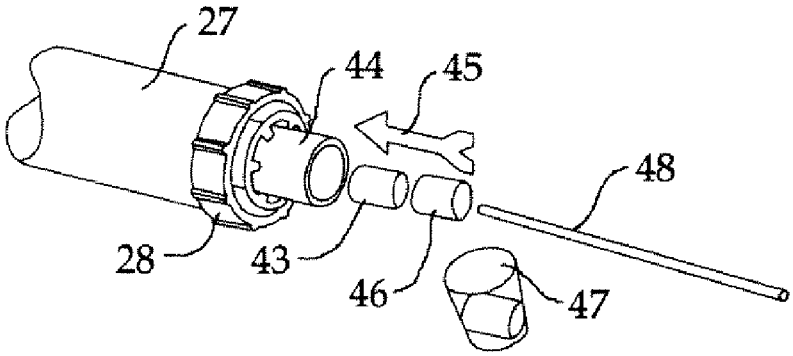
FIG. 3 illustrates an opening that has been created in the ice transport tube, and the placement of dry and wet conformable articles into the transport tube, being pushed therein via a push rod.

With reference now to FIG. 3, it will be seen that, for purposes of scraping debris from wall(s) of the transport tubes 27, 32 and 35, a dry conformable article 43 may be placed into the interior 44 of the tube 27, in the direction of the arrow 45 shown in FIG. 3, followed by wet conformable article 46 being placed through opening in the tube 44, after having been soaked in a sanitizing solution present in container 47. The sanitizing solution may be of a type that is designed to kill organisms, such as, but not limited to mold, algae and bacteria. The cleaning process also facilitates the removal of debris, mineral deposits and the like.

A push rod 48 may be used, to push the conformable articles, which will preferable be sponges, in the direction of the arrow 45, into the tube 44, toward the direction from which ice is generated in the ice making apparatus 10.

Figure 4:
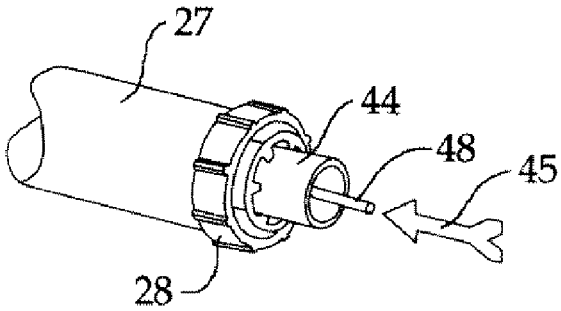
FIG. 4 is an illustration of the open transport tube, with the dry and wet conformable articles place therein.
Figure 5:
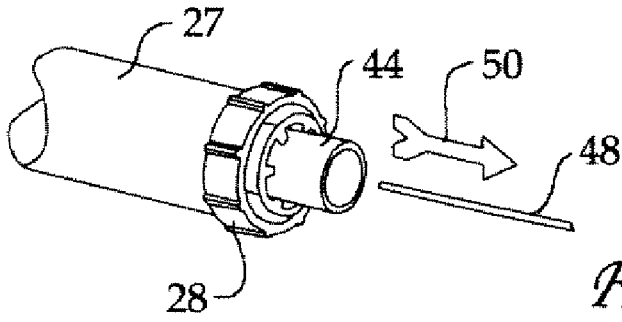
FIG. 5 is an illustration like that of FIG. 4, but wherein the push rod is shown being withdrawn from the transport tube.
Figure 6:
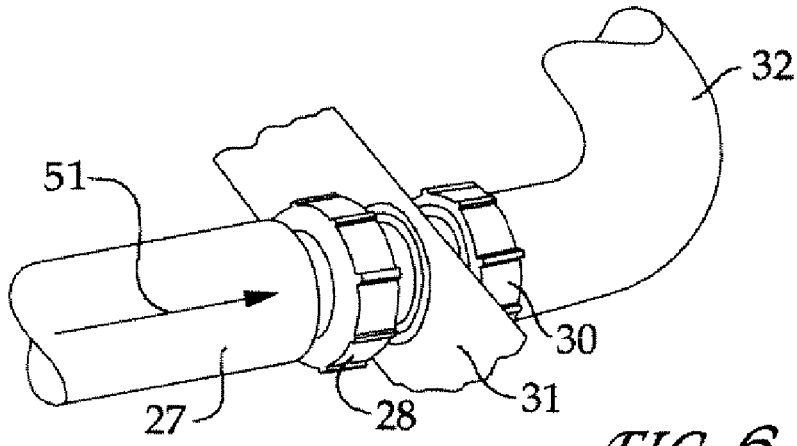
FIG. 6 is an illustration similar to that of FIG. 2, wherein the transport tube has been re-connected, so that there is no opening therein.
Figure 7:
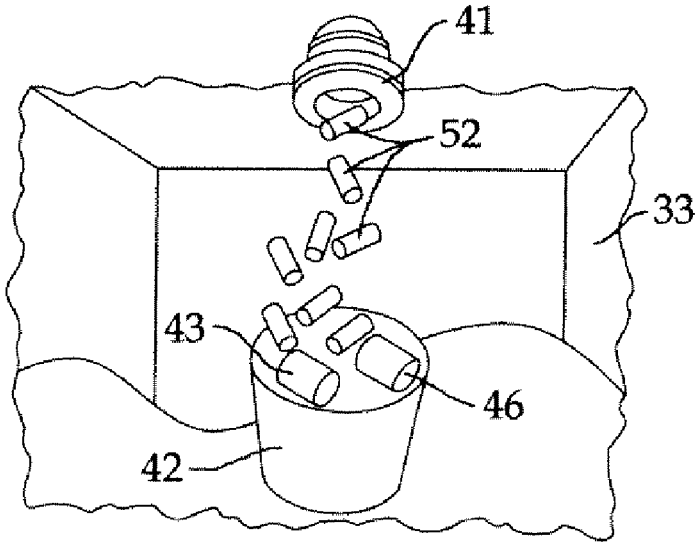
FIG. 7 is a fragmentary perspective view of the inside of the ice bin or ice retaining means illustrated in FIG. 1, wherein ice nuggets are being delivered thereto, through an inlet in the bin, and wherein the wet and dry conformable articles and the ice that pushes them through the transport tube is shown being collected for discard.

In FIG. 4, there is shown the completion of the step of inserting the sponges or other conformable articles 43, 46, into the tube 44, followed by withdrawal of the push rod 48 therefrom as shown in FIG. 5, in the direction of the arrow 50, leaving the sponges or other conformable articles 43, 46 in place. Thereafter, as shown in FIG. 6, the connectors 28, 30 may be reconnected on opposite sides of the support plate 31, by moving the tube 27 in the direction of the arrow 51 shown, and the connectors 28, 30 are tightly threaded together, so that the previously-made opening in the transport tube or ice delivery means 27, 32 is closed, whereby re-actuation of the motor means 13 will continue to drive ice via transport tubes 26, 27, 32, 35, to the storage bin 33 or other ice retaining means as described above, with such ice thereby pushing against the dry sponge or conformable articles 43, which, in turn, pushes against the wet sponge or conformable article 46, driving both through the inlet 41 to the storage bin 43, to be captured in container 42 in bin 43 which will collect the sponges 43, 46 and the immediately following ice nuggets 52 being delivered from the ice breakup means 36 through the inlet 41.

It will be appreciated that the dry sponge 43 is pushed by the ice, and, in turn, pushes the sanitizer-soaked 46. As ice generated from the ice making apparatus 10 is moved forward through the transport tube, it pushes the sponges ahead of it, compressing the dry sponge between the ice and the sanitizer-soaked sponge, so that the dry sponge expands and fills the inside diameter of the ice transport tube. The dry sponge can change shape with the variations in the inside diameter of the transport tube as the tube goes through bends or changes inside due to manufacturing tolerances, etc. The dry sponge also acts as a seal between the sponge that is soaked in sanitizer and the ice that is made with fresh water.

Thus, the dry sponge has tight contact with the wall(s) of the transport and removes any debris or organisms inside the transport tube. It will also be apparent that the dry sponge generally acts as a seal, and a majority of the sanitizing solution does not mix with the clean ice which pushes the sponges through the tube. Because it is the making of ice via the auger type ice-making apparatus 10 that pushes the sponges through the tube, the rate of travel of the sponges through the tube is sufficiently slow that it allows a good contact time between the sanitizer solution and the tube, to maximize the killing of organisms. Also, since the sanitizing solution is at room temperature or higher during its transport through the transport tube, it is more effective than ice that is made from a sanitizing solution.

It will thus be apparent that the present method of cleaning is an improvement over the above-described prior art methods of cleaning transport tubes in that it is more effective and does not require external equipment, such as vacuum equipment or pressure equipment, and allows the cleaning of a longer length of tubing than can generally be cleaned through prior art methods of cleaning transport tubes.

The sponges 43, 46 that are used as described above can be natural sponges, or artificial sponges made from cellulose or plastic material, as may be desired. Alternatively, they can be other conformable articles capable of water retention, transport tube scraping, expansion and compression, such as foam, plastic, cloth, fiberglass, etc., as may fulfill the broader purposes of this invention.

Figure 8:
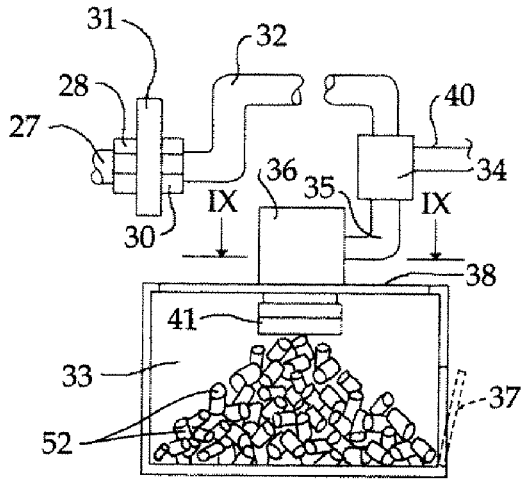
FIG. 8 is a fragmentary illustration of the ice transport tube and ice retaining means, ice breaking means and shuttle actuator (schematically illustrated) illustrated in FIG. 1, but wherein there is shown a buildup of ice nuggets in the bin or ice retaining means.
Figure 9:
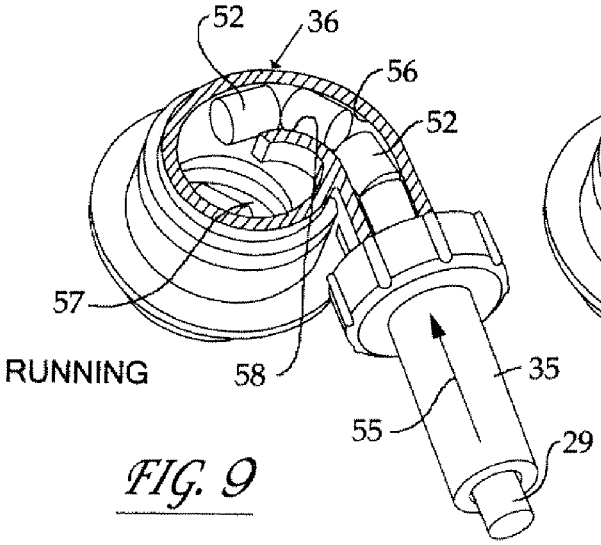
FIG. 9 is an enlarge, fragmentary, partially cross-sectioned illustration of the ice breakup means of FIG. 8, taken generally along the line IX-IX of FIG. 8, and wherein the delivery of ice nuggets is illustrated in the "running" position.

Referring now to FIG. 8 in detail, the ice breakup means 36 will now be described. It will be seen that the transport tube 35 delivers a longitudinal rod 29 of ice therethrough, in the direction of the arrow 55, to the interrupting means 36. Inside the interrupting means 36 there is provided an arcuate passageway that is generally helical in nature, as shown in FIG. 9, whereby a longitudinal rod 29 of ice is broken up into nuggets 52 that are driven through the passageway 56 serially, toward a discharge opening 57 therein, with the arcuate passageway 56 having at least one radial arc 58 that is helical, that turns ice from the rod(s) through at least a 90° arc, and that is selected of a dimensional size relative to the thickness of the longitudinal rod 29 of ice and the desired length of nuggets, 52, to break the longitudinal rod of ice 29 into nuggets 52 of a predetermined, desired, longitudinal dimension as the rod 29 of ice passes longitudinally through the tube 35 in the direction of the arrow 55, as shown.

A desirable predetermined length for the nuggets is approximately ¾ of an inch, although the same can vary upon the determination of other desired sizes, depending upon the needs of the user.

Thus, while the ice making apparatus 10 is running, the longitudinal rod 29 of ice will be broken up into nuggets 52 as shown, to be discharged via opening 57 into the interior of the ice bin 33, as shown in FIG. 8.

Figure 10:
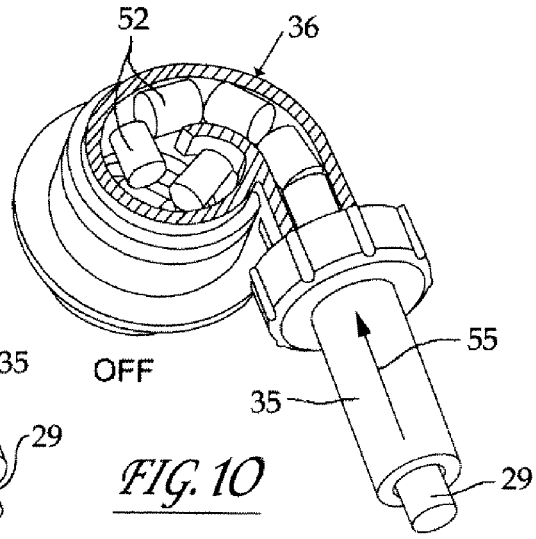
FIG. 10 is an illustration similar to that of FIG. 9, but wherein a buildup of ice in the ice retaining means has interrupted the delivery of ice, such that continued ice delivery is in the "off" position.

As ice nuggets 52 accumulate in the bin 33, as shown in FIG. 8, there can be a buildup of ice in the ice storage bin or other ice retaining means 33, as shown in FIG. 8, such that no more nuggets 52 can be accommodated in the bin 33 without causing undue stresses on a bin 33, bin lid 38, bin opening 37 or the like, potentially leading to forced opening of a lid 38 or the like or potential breakage of components, such that the backup of ice nuggets 52 can occur as shown in FIG. 10 and can be used to effect an interruption in ice delivery from the ice making apparatus 10, by shutting off the motor means 13, as will be described herein.

With reference to FIGS. 11-13, it will be seen that the control mechanism 34 illustrated in FIG. 8 is shown more specifically, such that a backup of ice nuggets 52 as shown in FIG. 10 with respect to transport tube 35, will cause a compression of a compression spring 60 inside the shutoff mechanism 34 as portion 61 of the interrupting means 34 moves in the direction of the arrow 52 to carry the sensor 63 mounted thereto, downwardly from the position shown in FIG. 12, to the position shown in FIG. 13.

With movement of the moveable member 61 of the interrupting means 34, in the direction of the arrow 62, the fork-like sensor 63 moves therewith, also in the direction of the arrow 62, such that an infrared beam or the like passing between fork legs 64, 65 of sensor 63, is broken by the flag 66 that interrupts the same as shown in FIG. 13, causing a connecting lead 40 that is connected to the motor means 13, to interrupt the drive provided by the motor means, 13, such that the ice making apparatus 10 discontinues its operation, until such time as the level of ice nuggets 52 in the bin 33 as shown in FIG. 8 is reduced, whereby the stopping forces exerted by the backup of nuggets 52 as shown in FIG. 10 is discontinued and whereby nuggets 52 can once again freely flow into the bin or other ice retaining means 33, such that the system will resume its "running" mode as shown in FIG. 9, in which the spring 60 shown in FIG. 13 may urge the moveable element 61 of the interrupting means 34 to be moved in the direction of the arrow 67, to resume the "running" position illustrated in FIG. 12.

It will thus be apparent that the interruption of delivery of ice and the resumption of ice delivery will be automatically controlled depending upon the level of ice buildup in the bin 33, such that interrupting means 34 can shuttle between the "running" and "off" modes respectively illustrated in FIGS. 12 and 13. It will be understood that the illustrations of the interrupting means 34 shown in FIGS. 8 and 11 through 13 are intended to show the basic operation of components, and that these illustrations of FIGS. 11-13 are not necessarily oriented in the same manner as is the orientation of the interrupting means 34 shown in FIG. 8.

It will also be understood that the operation of the interrupting means 34 is responsive to buildup of ice in the ice storage bin, which will cause jamming of ice nuggets in the ice breakup means shown in FIGS. 9 and 10.

The bin 33 may take any of various forms, as shown in FIG. 1, or as described in any of U.S. Pat. Nos. 6,685,053; 5,211,030; 5,887,758; 5,797,514 of 5,542,573 or any other form, all of which are herein incorporated by reference.

It will be apparent from the foregoing that various modifications may be made in the details of construction, as well as in the use and operation of the apparatus described herein. It will also be understood that where apparatus or components is described as "means", followed by a function, all possible operating means that can fulfill that function are intended to be encompassed and that the embodiments that are set forth herein are illustrative only and not intended to be limiting. Other variations may be made in the use and operation of the equipment, as well as in its construction, all within the spirit and scope of the invention as defined in the appended claims.

What is claimed is:

1. Apparatus for providing nuggets of extruded, flaked or chipped ice to a storage bin comprising:

(a) a chamber for accumulating freezing water on a chamber wall;

(b) rotatable auger apparatus for scraping ice from the chamber wall and forming at least one longitudinal strip of compressed flaked or chipped ice;

(c) refrigeration apparatus for freezing water in the chamber;

(d) an ice storage bin;

(e) an ice delivery tube for conveying at least one longitudinal rod of ice to an inlet of the storage bin;

(f) ice breakup means at the inlet to the storage bin for breaking the at least one longitudinal rod of ice into nuggets of predetermined size;

(g) said ice breakup means composing an arcuate passageway located proximate the inlet to the storage bin for receiving the at least one longitudinal rod of ice:

(h) with the arcuate passageway including at least one radial arc of a size selected to correspond to predetermined length for the nuggets in the longitudinal direction.

2. The apparatus of claim 1, wherein the predetermined length of the nuggets is approximately ¾ inch.

3. The apparatus of claim 1, wherein the arcuate passageway comprises means for guiding the rod(s) of ice through an arc of at least 90°.

4. The apparatus of claim 1, wherein the predetermined length of the nuggets is approximately ¾ inch, wherein the arcuate passageway is helical, wherein the arcuate passageway comprises means for guiding the rod(s) of ice through an arc of at least 90°.

5. Apparatus for providing nuggets of extruded, flaked or chipped ice to a storage bin comprising:

(a) a chamber for accumulating freezing water on a chamber wall;

(b) rotatable auger apparatus for scraping ice from the chamber wall and forming at least one longitudinal strip of compressed flaked or chipped ice;

(c) refrigeration apparatus for freezing water in the chamber;

(d) an ice storage bin;

(e) an ice delivery tube for conveying at least one longitudinal rod of ice to an inlet of the storage bin;

(f) ice breakup means for breaking the at least one longitudinal rod of ice into nuggets of predetermined size;

(g) said ice breakup means comprising an arcuate passageway located proximate the inlet to the storage bin for receiving the at least one longitudinal rod of ice;

(h) with the arcuate passageway including at least one radial arc of a size selected to correspond to a predetermined length for the nuggets in the longitudinal direction;

wherein the arcuate passageway is helical.

* * * * *